US006789947B1

(12) United States Patent
Kasai

(10) Patent No.: US 6,789,947 B1
(45) Date of Patent: Sep. 14, 2004

(54) PLASTIC FASTENER WITH SLIDER AND BAG BODY PROVIDED WITH THE PLASTIC FASTENER AND METHOD OF PRODUCING THE BAG BODY

(75) Inventor: Juichi Kasai, Tokyo (JP)

(73) Assignee: Showa Highpolymer Co., Ltd., Tokyo (JP)

( * ) Notice: Subject to any disclaimer, the term of this patent is extended or adjusted under 35 U.S.C. 154(b) by 0 days.

(21) Appl. No.: 10/129,267

(22) PCT Filed: Nov. 7, 2000

(86) PCT No.: PCT/JP00/07806

§ 371 (c)(1),
(2), (4) Date: May 3, 2002

(87) PCT Pub. No.: WO01/34487

PCT Pub. Date: May 17, 2001

(30) Foreign Application Priority Data

Nov. 8, 1999 (JP) ..... 11-316469

(51) Int. Cl.[7] ..... B65D 33/16
(52) U.S. Cl. ..... 383/64; 24/400
(58) Field of Search ..... 383/64, 24; 24/399, 24/400

(56) References Cited

U.S. PATENT DOCUMENTS

| | | | | | |
|---|---|---|---|---|---|
| 5,007,143 | A | * | 4/1991 | Herrington | 24/400 |
| 5,020,194 | A | | 6/1991 | Herrington et al. | |
| 5,442,837 | A | | 8/1995 | Morgan | |
| 5,664,299 | A | * | 9/1997 | Porchia et al. | 24/400 |
| 5,729,876 | A | | 3/1998 | Johnson | |
| 5,953,796 | A | * | 9/1999 | McMahon et al. | 24/400 |
| 5,983,466 | A | * | 11/1999 | Petkovsek | 24/400 |
| 6,220,754 | B1 | * | 4/2001 | Stiglic et al. | 383/64 |
| 6,402,375 | B1 | * | 6/2002 | Schreiter et al. | 383/64 |
| 6,491,432 | B2 | * | 12/2002 | May | 383/64 |
| 6,575,628 | B1 | * | 6/2003 | Borchardt et al. | 383/64 |
| 6,581,249 | B1 | * | 6/2003 | Savicki et al. | 24/30.5 R |

FOREIGN PATENT DOCUMENTS

| | | |
|---|---|---|
| GB | 778594 | 7/1957 |
| JP | 5-505325 | 8/1993 |
| JP | 7-300145 | 11/1995 |
| JP | 10-503672 | 4/1998 |
| WO | WO 91/13565 | 9/1991 |
| WO | WO 95/35048 | 12/1995 |

OTHER PUBLICATIONS

Patent Abstracts of Japan, JP 8–324595, Dec. 10, 1996.

* cited by examiner

*Primary Examiner*—Jes F. Pascua
(74) *Attorney, Agent, or Firm*—Oblon, Spivak, McClelland, Maier & Neustadt, P.C.

(57) ABSTRACT

There are disclosed a plastic zipper with a slider, comprising a pair of male hook and female hook formed on plastic films and a slider by which the zipper is opened and closed, wherein the zipper is equipped with protrusions serving as a guide for the slider which are installed parallel to the male hook and female hook respectively on the side of an opening portion of the zipper, and the slider is equipped with an inside guide which engages with the protrusions so that the inside guide is positioned between the protrusions and the hooks on the side of the opening portion of the zipper; a bag body equipped with the above plastic zipper; and a process for effectively producing the bag body. The plastic zipper with the slider and the bag body equipped with the plastic zipper are each excellent in hermetic sealing performance, and are well suited for packaging liquid without causing leakage.

9 Claims, 11 Drawing Sheets

PLASTIC FASTENER WITH SLIDER AND BAG BODY PROVIDED WITH THE PLASTIC FASTENER AND METHOD OF PRODUCING THE BAG BODY

FIELD OF THE INVENTION

The present invention relates to a plastic zipper which has a slider and in which hermetic sealing performance is not impaired even by repeated opening and closing operations, a bag body equipped with the plastic zipper and a process for producing the bag body.

DESCRIPTION OF THE RELATED ART

Bag bodies each equipped with a plastic zipper are widely employed as packaging materials for a variety of articles in the fields of foods, pharmaceuticals, electronic part items and the like. There have hitherto been proposed various items relating to the structure of this kind of plastic zipper and a slider for opening and closing the same [for instance, Japanese Patent Application Laid-Open No. 214920/1996 (Heisei 8)]. In general, the structure of a plastic zipper is constituted as illustrated in FIG. 20 in which F is a plastic film, F1-1 and F1-2 are each a female hook formed on the plastic film, M1-1 is a male hook, and the zipper is closed when the male hook is inserted in and engaged with the two female hooks.

The slider which is usually employed is composed generally of an outside guide and an inside guide in such a structure that the inside guide is inserted between the male hook and the female hooks and causes the male/female hooks to disengage, while the outside guide sandwiches the male/female hooks therein and causes the male/female hooks to engage. Since in the slider of the conventional structure, the inside guide is inserted between the hooks of a zipper, even if the zipper is completely bound tight, the content in a bag leaks between the hooks and the inside guide which is inserted between the hooks. Hence, the above-mentioned zipper is unusable for applications requiring hermetic sealing except for applications only not requiring hermetic sealing such as general cargoes.

On the other hand, there is proposed a zipper having such a structure that hermetic sealing can be maintained in a state of a bag being closed with a slider by the use of a specially shaped plastic zipper and a slider adapted thereto (for instance, U.S. Pat. Nos. 6,067,208 and 6,664,299). In the plastic zippers as disclosed therein, hermetic sealing performance is maintained by taking advantage of the elasticity of the plastic material which constitutes the zipper for the purpose of facilitating the disengagement even with a weak force, and therefore when the elasticity thereof varies with a variation in temperature or the like, there is caused a fear of incapability of maintaining the hermetic sealing performance after opening and closing operations, whereby the amount of leakage is increased. Such being the case, the above-proposed zippers are unusable for packaging such content as liquid and the like in which occurrence of leakage is forbidden.

The present inventors previously proposed a zipper having good hermetic sealing performance equipped with a sealing portion bondable to the inside of male and female hooks respectively, more specifically, a plastic zipper having good hermetic sealing performance characterized as illustrated in FIG. 21 by forming male hooks M2-1, M2-2 and female hooks F2-1, F2-2 of the zipper on the surface of a plastic film F, forming a continuous tightening wall R1 parallel to the male hooks M2-1, M2-2 on the inside thereof, and further forming a continuous pressing rib R2 parallel to the female hooks F2-1, F2-2 on the inside thereof, so that the zipper is imparted with excellent properties in persistent hermetic sealing performance and also impact resistance by the tight contact between the continuous tightening wall R1 and the continuous pressing rib R2 as well as self-tightening effect thereof (Japanese Patent Registration No. 2,938,784). The plastic zipper is excellent in hermetic sealing performance and impact resistance and almost free from performance variation due to temperature variation, and accordingly is well suited for packaging liquid and the like. However, it remains unsolved to develop a slider that does not impair the hermetic sealing performance of the aforesaid plastic zipper.

Accordingly, the object of the present invention is to solve the disadvantages of the previous plastic zipper fitted with a slider and the previous bag body equipped with the previous plastic zipper, and also to provide a plastic zipper which is fitted with a slider and which is excellent in hermetic sealing performance having a slider that never impairs the hermetic sealing characteristics; a bag body equipped with said zipper; and a process for producing said bag body.

BRIEF SUMMARY OF THE INVENTION

As a result of intensive research and investigation made by the present inventors, it has been made possible to eliminate the previous disadvantage of insufficiency in the hermetic sealing performance and according to a proposal of the present inventors, to develop a plastic zipper which has a slider and is capable of assuring sealing characteristics, a bag body equipped with said zipper and also a process for producing said bag body. The present invention has been accomplished on the basis of this development.

That is, the present invention provides a plastic zipper with a slider, comprising a pair of male hook and female hook formed on plastic films and a slider by which the zipper is opened and closed, wherein the zipper is equipped with protrusions serving as a guide for the slider which are installed parallel to the male and female hooks, respectively on the side of an opening portion of the zipper, and the slider is equipped with an inside guide which engages with the protrusions so that the inside guide is positioned between the protrusions and the hooks on the side of the opening portion of the zipper.

At the same time, the present invention provides said plastic zipper wherein the inside guide is formed in a bilaterally asymmetrical manner, and is constituted such that in a step of opening operation, it opens the female hook outward, thereafter opens the male hook, and subsequently opens the protrusions to a large extent at the opening end of the slider, thus opening the zipper portion.

Also, said plastic zipper has hollows which allow the inside guide of the slider to fit therein are installed on the opening side of the zipper end portion.

Further, the plastic zipper is a hermetic sealing zipper that is equipped with a bondable sealing portion inside the male hook and a bondable sealing portion inside the female hook separately from a locking portion of the zipper.

Furthermore, the bag body according to the present invention is equipped with the plastic zipper which has the slider and which is characterized by the preceding description.

The length of heat seal to be overhanged to the inside of the bag at the closing end of the plastic zipper with the slider is set on a length equal to or more than the distance between the closing end of the slider and the opening end thereof.

The process for producing the bag body of the present invention is characterized by a guide-constituting member equipped with an inside guide portion has opening ability and closing ability formed through a flexural portion having an axis for flexure perpendicularly intersecting a plane containing a bag body, is attached to a slider body so as to constitute a slider, the slider is mounted on a zipper in a state that the guide-constituting member is opened through the flexural portion, and subsequently the guide-constituting member is closed through the flexural portion, thereby accomplishing the mounting of the slider onto the zipper.

DESCRIPTION OF THE SYMBOLS IN THE DRAWINGS

F: plastic film
C: zipper portion
S: slider
F1-1, F1-2: female hook
F2-1, F2-2: female hook
M1-1: male hook
M2-1, M2-2: male hook
G1-1, G1-2: protrusion
G2-1, G2-2: protrusion
S-1: inside guide of slider
S-2: outside guide of slider
S-3*a,* S-3*b:* left/right constitutional members for slider
H-1, H-2: hollow
R1: continuous tightening wall
R2: continuous pressing rib Preferred Embodiments of the Invention The embodiments of the present invention will be described with reference to FIGS. 1–19.

Figure 1:
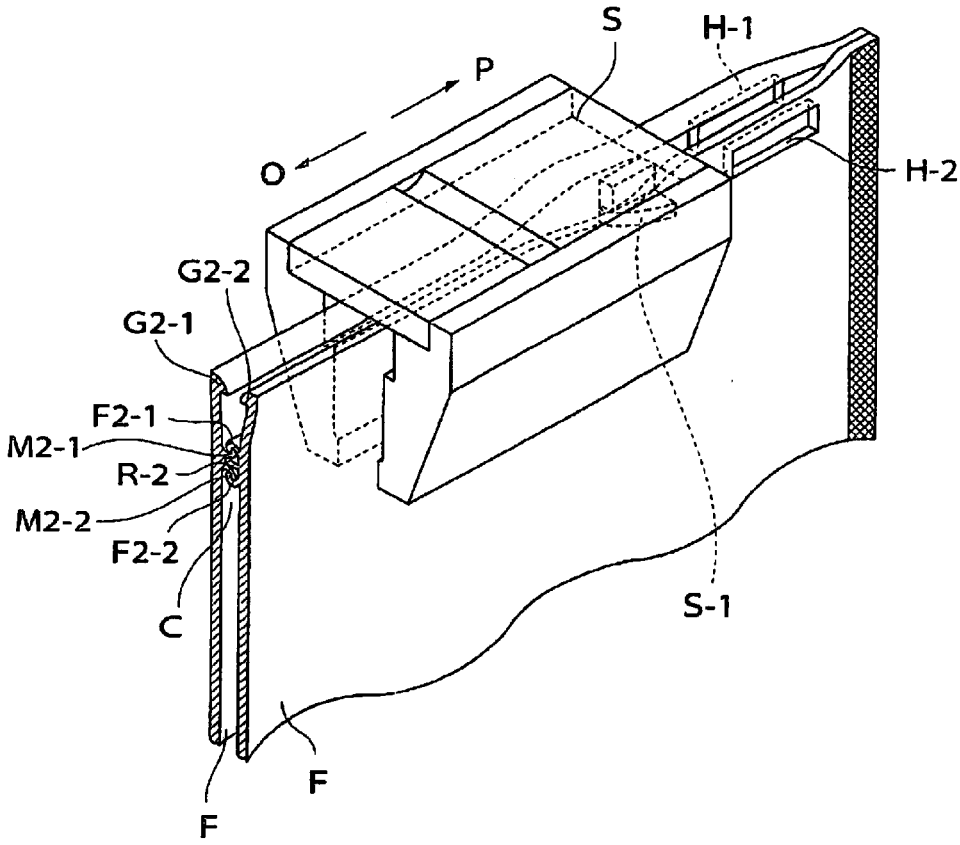
FIG. 1 is a perspective view showing the principal portions of a plastic zipper with a slider and a bag body equipped with the plastic zipper each being related to the present invention.
Figure 2:
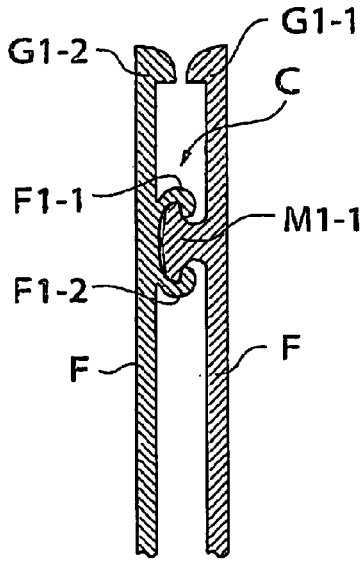
FIG. 2 is a cross sectional view showing an example of the principal portion of a protrusion which is attached to a conventional plastic zipper and which serves as a guide for a slider.
Figure 3:
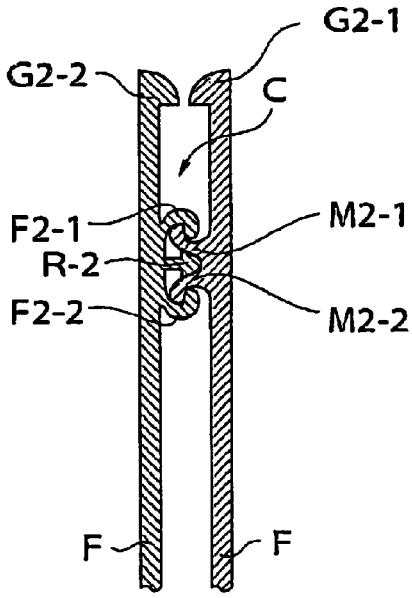
FIG. 3 is a cross sectional view showing an example of the principal portion of a protrusion which is attached to a hermetic sealing plastic zipper and which serves as a guide for a slider.

FIG. 1 is a perspective view showing the principal portions of a plastic zipper with a slider and a bag body equipped with the plastic zipper, FIG. 2 is a cross sectional view showing an example of the principal portion of a protrusion which is attached to a conventional plastic zipper and, and FIG. 3 is a cross sectional view showing an example of the principal portion of a protrusion which is attached to a hermetic sealing plastic zipper. In these figures, F is a plastic film, F1-1 and F1-2 are each a female hook in the zipper, M1-1 is a male hook in the same, F2-1 and F2-2 are each a female hook in a hermetic sealing zipper, M2-1 and M2-2 are each a male hook in the same, C is a zipper portion composed of these male and female hooks and S is a slider.

As illustrated in FIGS. 1, 2 and 3, protrusions G1-1, G1-2, G2-1 and G2-2 each serving as a guide for a slider are installed each on the side of opening portion (upper end side in the figures) of the hook for the zipper C in a state of being parallel to the male hook (M1-1 in a conventional zipper, and M2-1 and M2-2 in a hermetic sealing zipper) of the zipper portion C and to the female hooks (F1-1, F1-2 in a conventional zipper, and F2-1 and F2-2 in a hermetic sealing zipper) of the zipper portion C. The slider S is equipped with an inside guide S-1 which is engaged with the aforesaid protrusions (G1-1, G1-2, G2-1 and G2-2) so that the inside guide is located between each of the aforesaid protrusions (G1-1, G1-2, G2-1 and G2-2) and the female hooks F1-1, F2-1 on the side of opening portion (upper side in the figures) for the zipper C.

Figure 4:
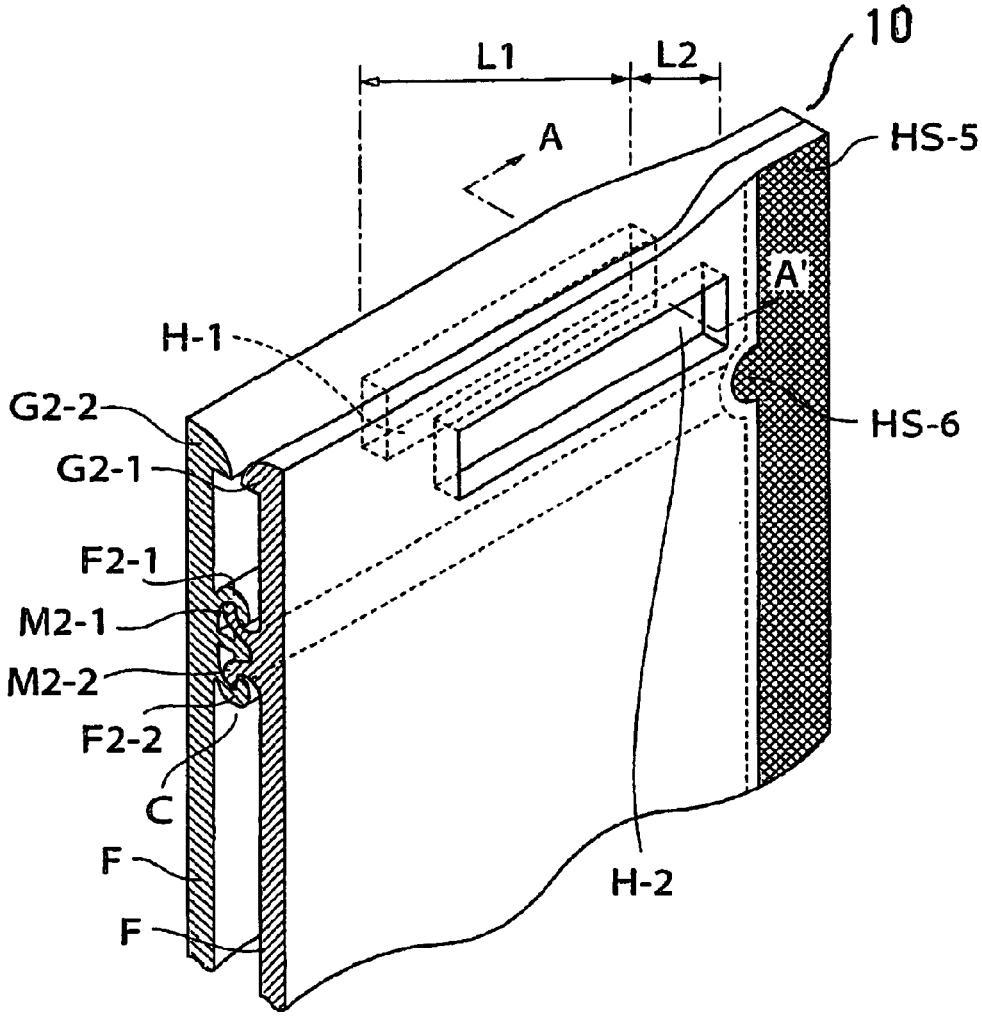
FIG. 4 is a perspective view showing the principal portion for an example of a hollow, which is provided on a bag body and into which an inside guide of a slider, is fitted.

FIG. 4 is a perspective view showing the principal portion for an example of a hollow that is provided on a bag body and into which an inside guide of a slider is fitted. As illustrated in FIG. 4, the end portion of a bag body equipped with a plastic zipper is usually heat sealed with heat seal HS-5. Hollows H-1, H-2 which allow the foregoing inside guide of a slider to fit therein are installed at a position immediately in front of the heat seal portion between the upper part of the female hook F2-1/male hook M2-1 on the side of opening portion (upper side in the figure) and the aforesaid protrusions G2-2, G2-1.

Figure 5:
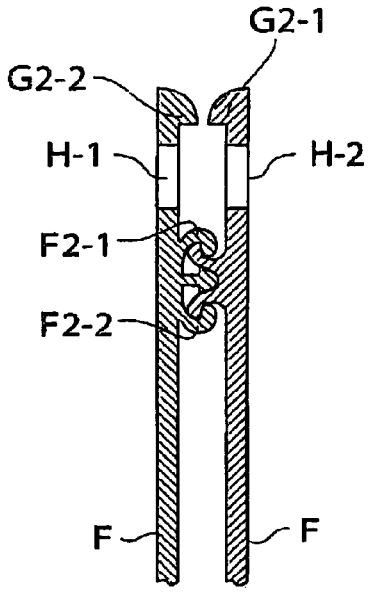
FIG. 5 is a cross sectional view taken along line A–A' of FIG. 4.

FIG. 5 is a cross sectional view taken along line A–A' of FIG. 4.

Figure 6:
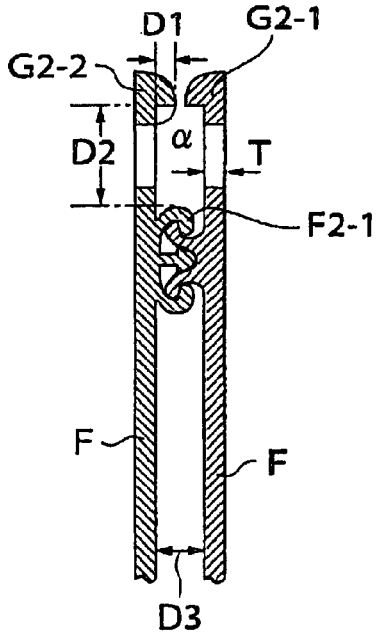
FIG. 6 is an enlarged cross sectional view showing the principal portion of the protrusion shape.
Figure 7:
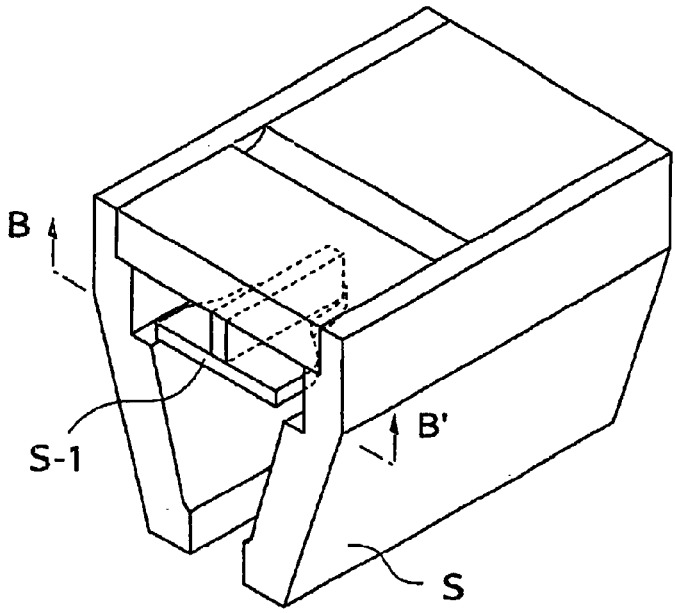
FIG. 7 is a perspective view showing a slider.

FIG. 6 is an enlarged cross sectional view showing the principal portion of protrusion shape, wherein the distance D 2 between the female hook F2-1 and the aforesaid protrusions G2-1, G2-2 is preferably as short as possible. Although being restricted by the depth of the inside guide S-1 (as shown in FIG. 7) of the slider S, it is preferable to set the distance D2 on about 1.5 mm to 0.5 mm, the degree of protrusion $\alpha$ on the range of 60 to 90 degrees, and the depth of protrusion D1 on at least half the width D3 of the zipper. The shape of the protrusion is not specifically limited, provided that it does not interfere with the external appearance of the zipper. In order to facilitate the attachment of the inside guide S-1 of the slider S, the protrusion is preferably shaped in the form of semi-ellipsoid. The thickness of the flange on the opening side (upper side) T is sufficient, when it is such an extent that the flange in the vicinity of the hollow H-1, H-2 is immune to elongation or breakage due to the opening force of the above-mentioned inside guide S-1. Preferably, the thickness T is 200 micrometer, approximately.

Figure 8:
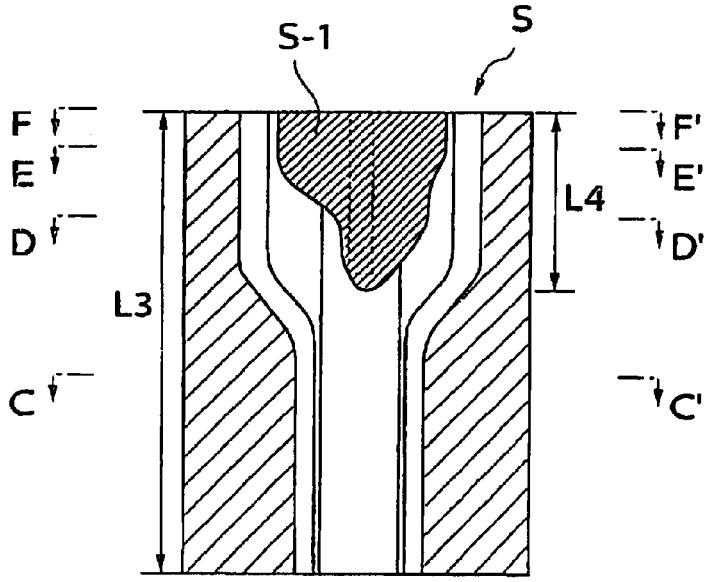
FIG. 8 is a cross sectional view taken along line B–B' of FIG. 7.
Figure 9:
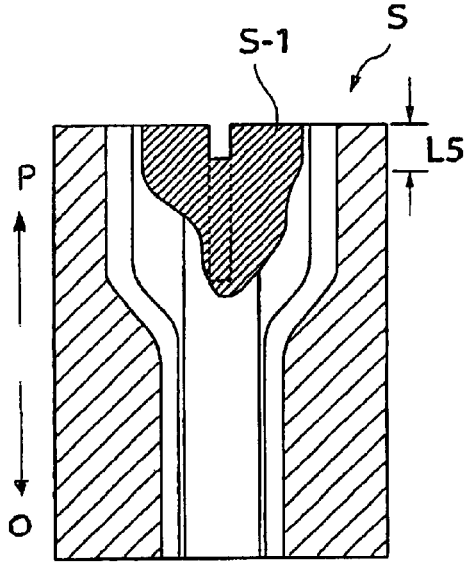
FIG. 9 is a cross sectional view showing the principal portion of the inside guide.

FIGS. 7–9 each illustrates the structure of the slider S, wherein FIG. 7 is a partially sectional perspective view, while FIGS. 8 and 9 are each cross sectional view. The shape of the inside guide S-1 is shown in FIG. 8 which is a cross sectional view taken along line B–B' of FIG. 7. The internal structure of the slider S and the opening or closing state of the zipper portion C are shown in FIGS. 10, 11, 12 and 13 that are each a cross sectional view taken along lines C–C' of FIG. 8, D–D' thereof, E–E' thereof, and F–F' thereof, respectively, each being in a state that the slider S in FIG. 7 is installed on the zipper. It is enabled to open and close the zipper portion C by the sliding of the inside guide S-1 in the portion between the protrusions G2-1, G2-2 and the zipper portion C.

Figure 10:
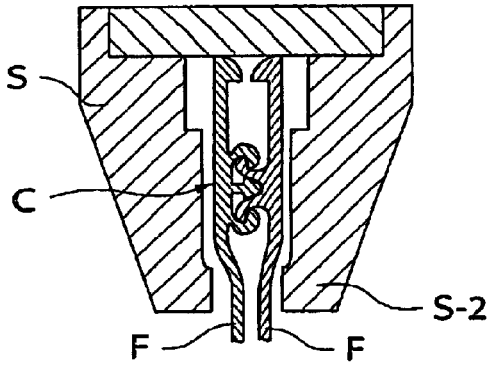
FIG. 10 is a cross sectional view which is taken along line C–C' of FIG. 8 and which shows the step of zipper opening by the slider in a state that the slider S in FIG. 7 is installed on a zipper.
Figure 11:
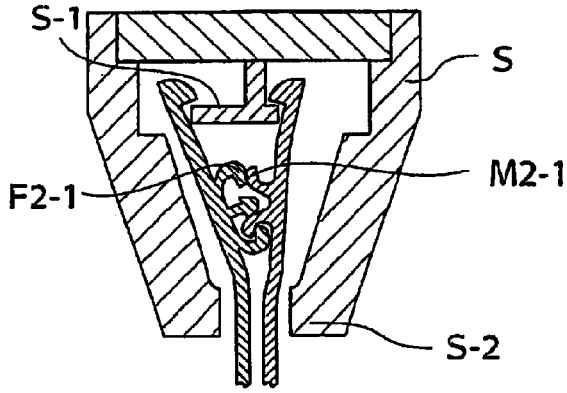
FIG. 11 is a cross sectional view which is taken along line D–D' of FIG. 8 and which shows the step of zipper opening by the slider in a state that the slider S in FIG. 7 is installed on the zipper.
Figure 12:
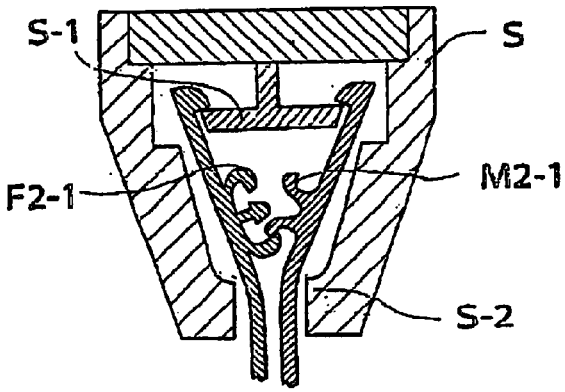
FIG. 12 is a cross sectional view which is taken along line E–E' of FIG. 8 and which shows the step of zipper opening by the slider in a state that the slider S in FIG. 7 is installed on the zipper.
Figure 13:
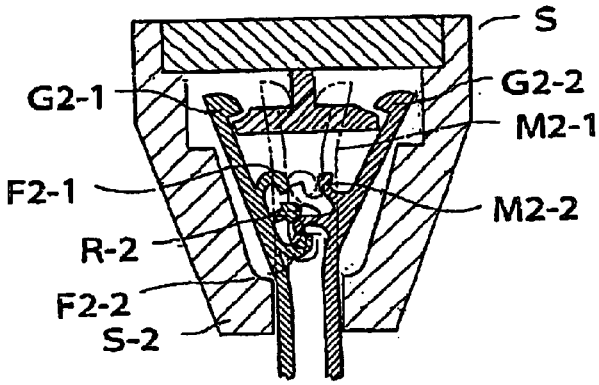
FIG. 13 is a cross sectional view which is taken along line F–F' of FIG. 8 and which shows the step of zipper opening by the slider in a state that the slider S in FIG. 7 is installed on the zipper.
Figure 14:
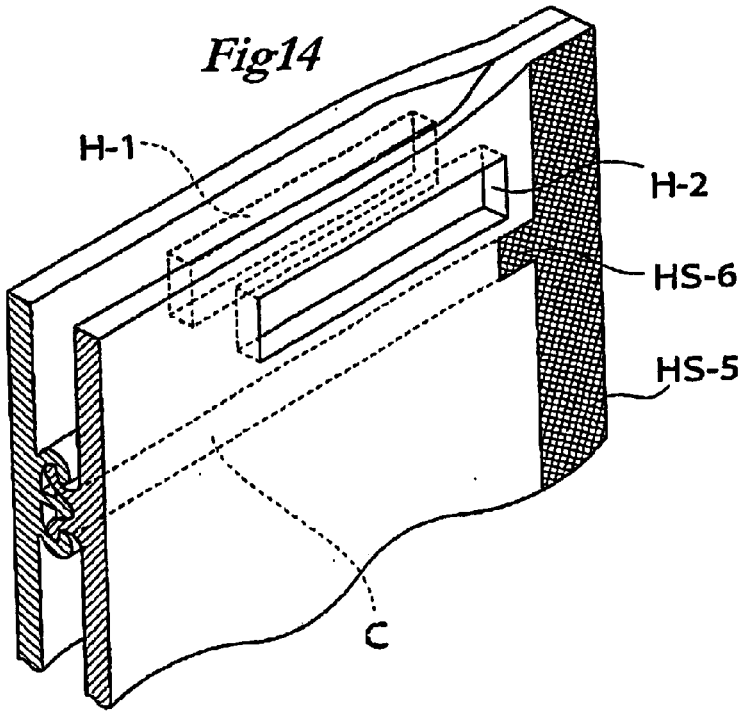
FIG. 14 is a perspective view showing the principal portion of overhanged sealing portion.

As illustrated in FIG. 10, the inside guide S-1 is absent at the closing end of the slider S without working (thus not indicated on the figure), and the zipper portion C is closed by the outside guide S-2. By rendering the slider S bilaterally asymmetrical as illustrated in FIGS. 8 and 9, in the case where the zipper is opened by moving the slider S in FIG. 1 in the direction of "O" (in FIG. 1, the slider is depicted in the bilaterally reverse direction against FIG. 7), the inside guide S-1 opens the female hook F2-1 outward (FIG. 11), thereafter opens the male hook M2-1 (FIG. 12), subsequently opens the protrusions G2-1, G2-2 to a large extent at the opening end of the slider (FIG. 13), thus open the zipper portion. Conversely in the case where the zipper portion C is closed by moving the slider S on FIG. 1 in the direction of "P", the zipper portion C and the slider S reversibly function. When the slider S reaches the vicinity of the heat seal portion at the end of the zipper portion C, the inside guide S-1 stops in a state of being fitted into the hollow H-1, H-2 (shown in FIG. 4) as indicated by the dotted line in FIG. 13.

In the foregoing state, the slider S, when reaches the heat seal portion HS-5 of the bag body 10 (shown in FIG. 4) while closing the zipper, functions so as to prevent the zipper from opening at the opening end portion of the slider S and at the same time, provides an operator with such feeling as enabling to clearly understand that the slider S has stopped distinctly. Therefore, the zipper is so constituted as capable of preventing leakage due to incomplete or obscure stoppage.

As illustrated in FIG, 4, the distance L2 between the heat seal portion HS-5 and the hollow H-1, H-2 is preferably as short as possible. Preferably, the length of the hollow L-1 is more than the length L4 of the inside guide S-1 (shown in FIG. 8), and less than the length L3 of the slider S. The distance between the closing end of the slider S and the opening end thereof (the distance between line C–C' of FIG. 8 and line F–F' thereof) is usually about 5 mm. It enables to prevent leakage through between the closing end and the opening end each for the slider by providing, at the closing end of the zipper portion as shown on FIG. 14, a overhanged portion HS-6 wherein the heat seal is protruded into the inside of the bag in a length comparable to or more than the distance between the closing end and the opening end each for the slider S (the distance between the line C–C' and line F–F' each of FIG.8). In this case, by concaving the opening end side of the inside guide S-1 as shown in FIG. 9, it is enabled to decrease the distance between the closing end of the slider and the opening end thereof by an equivalent to L5.

In the following description, detailed explanation will be given regarding the plastic zipper that has a slider and the foregoing constitution according to the present invention, while comparing with the above-mentioned U.S. Pat. No. 5,067,208 (hereinafter referred to as "First USP") and U.S. Pat. No. 5,664,299 (hereinafter referred to as "Second USP"). The mechanism as described in the First USP and that of the present invention are the same in that the inside guides passes through the outside of the zipper portion. However, since the First USP is based on the premise that use is made of easily disengaging zipper portion, the outside of the zipper is curved in the form of arc. The zipper of such constitution is unusable when a strong force is applied thereto on opening and closing operations as in the case with a hermetic sealing zipper because the arc causes flexure.

As opposed thereto, the present invention copes with a strong force applied upon opening and closing operations by providing a protrusion on a flange portion in the opening side of the zipper, and further by maintaining the length and angle thereof each at an appropriate level. The present invention is therefore, entirely different from the First USP in function as well as constitution. The mechanism as described in the Second USP is of such a structure that an inside guide directly pressingly opens either of two hooks of the zipper, and the protrusion present only on the outside of either side of the hooks is a guide to pressingly open the thin hook without fail.

As opposed thereto, the present invention is characterized by pressingly opening only the protrusions present on both the side of the zipper completely irrespective of the hooks. The present invention is therefore, entirely different from the Second USP in function as well as constitution.

The structure equivalent to the hollow H-1, H-2 penetrating between the protrusions G2-1, G2-2 can be said to be the structure in the First USP wherein the zipper has a notch at the upper part thereof. This structure is effective in the case of using the special zipper which is described in the First USP, and which is likely to be readily disengaged. In the case however, where an opening force is applied to the zipper as is the case with the present invention, it needs to provide protrusions as a guide for zipper. Without such protrusions, the zipper cannot be opened only with the inside guide S-1, and hence the structure described in the First USP is inapplicable to the present invention.

As described in the First USP, in order to stop the slider in the case of the notch, it is necessary to provide clips for stoppage on both ends of the zipper. On the contrary, the structure in the present invention needs not any clip but needs only the hollow and hence, is markedly economical as compared with that of the First USP.

Although having been described on the hermetic sealing zipper, the embodiment of the present invention is not limited thereto, but of course, is widely applicable to general-purpose zippers including conventional zippers.

The present invention, when being put into practice with an ordinary operation, requires an extremely intricate step in equipping the zipper portion with the slider S, including the step of keeping the zipper closed at the closing end of the slider, and at the opening end thereof, inserting the inside guide S-1 into the inside of the protrusions G2-1, G2-2 at the upper part of the zipper. Moreover, in an attempt to economically produce a bag body equipped with a plastic zipper having a slider according to the present invention, it is needed to equip the zipper portion with the slider S simultaneously with the production of a bag by means of a bag-making machine. Accordingly, since the production rate with a bag-making machine is usually about 60 bags per minute, the slider-fitting rate is set on a similar rate.

Figure 15:
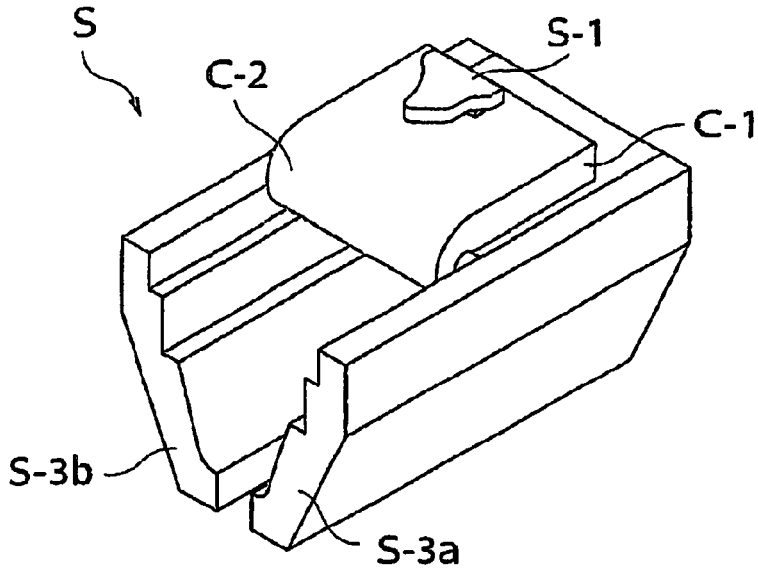
FIG. 15 is a perspective view showing the principal portion for a constitution example of installing an inside guide on a slider.
Figure 16:
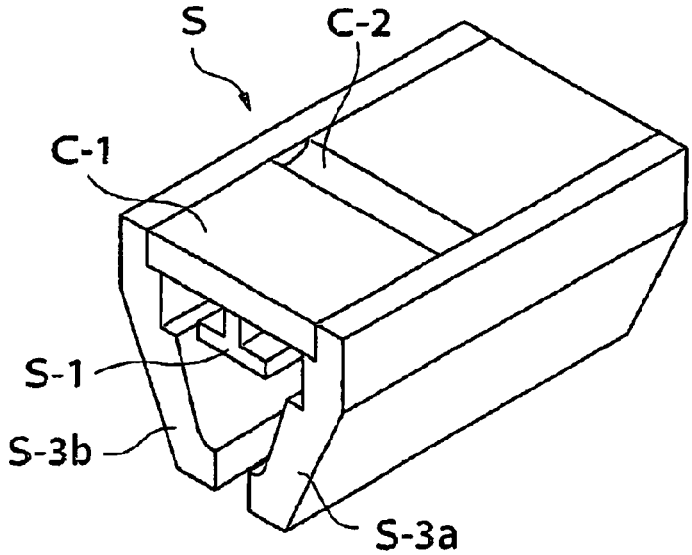
FIG. 16 is a perspective view showing the principal portion for a state of having installed an inside guide on a slider.
Figure 17:
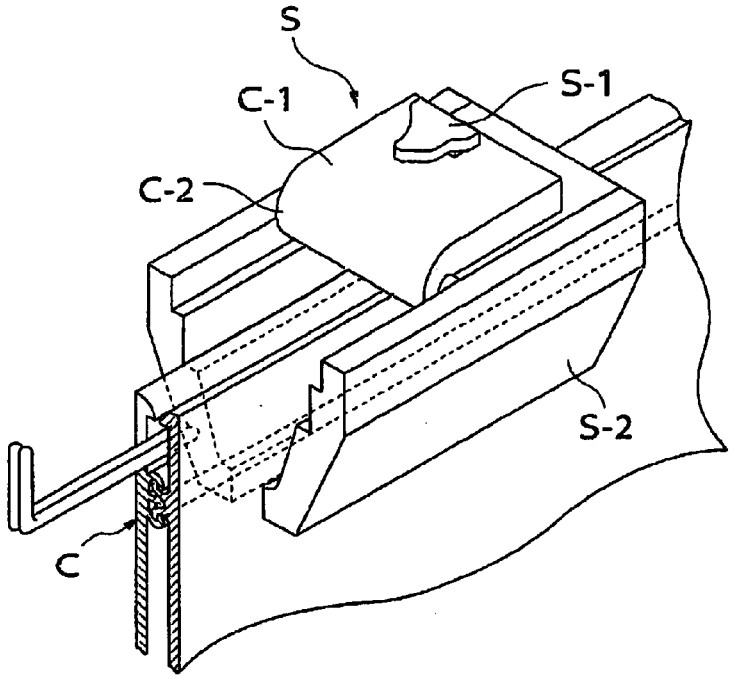
FIG. 17 is a perspective view showing the principal portion for the step of equipping the zipper with a slider.
Figure 18:
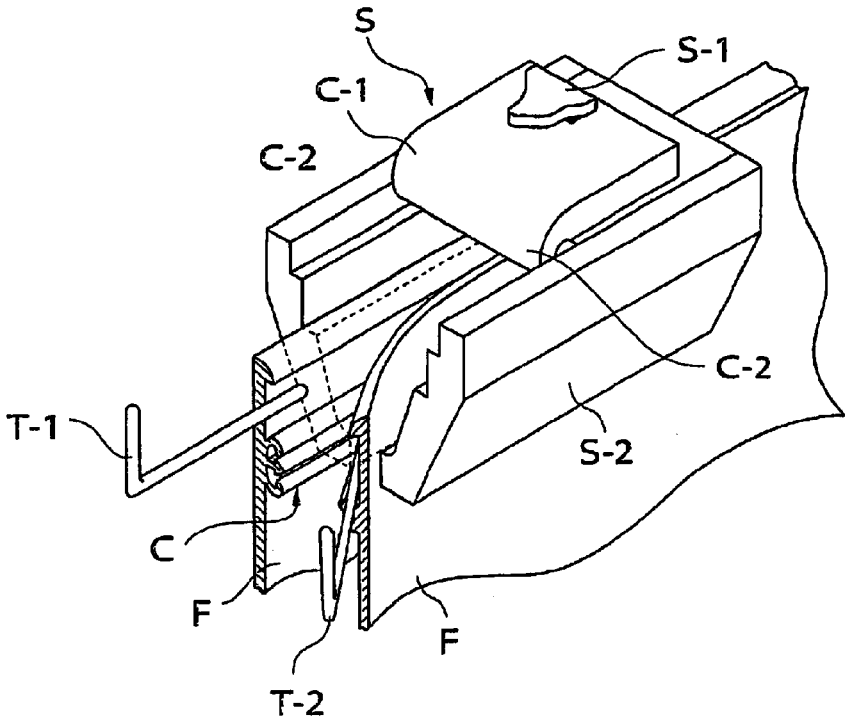
FIG. 18 is a perspective view showing the principal portion for the step of equipping the zipper with a slider by the use of a jig.
Figure 19:
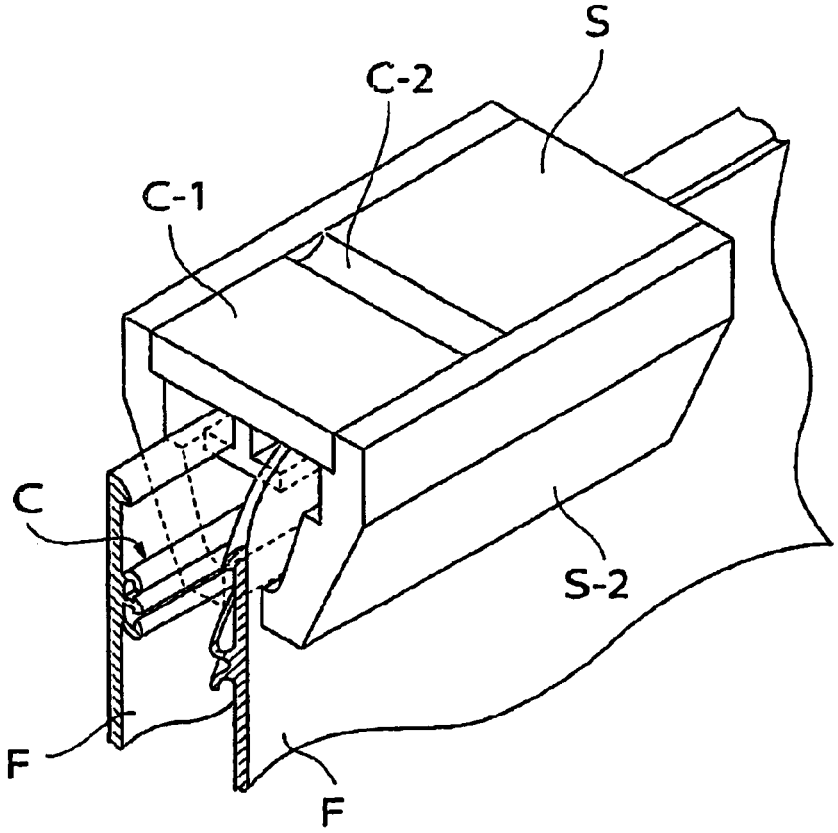
FIG. 19 is a perspective view showing the principal portion for the step of equipping the zipper with a slider in a state that a constitutional member of the inside guides is turned over.
Figure 20:
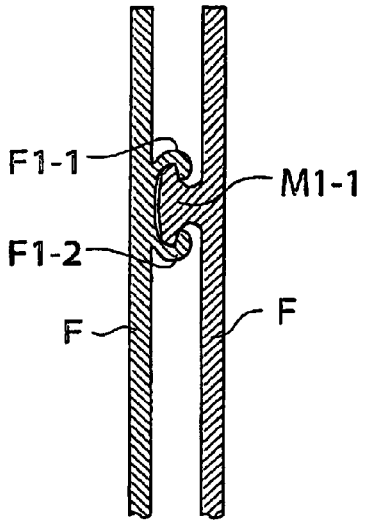
FIG. 20 is a cross sectional view showing a conventional zipper.

In order to solve this subject in the present invention, the zipper is constituted in such a manner that as illustrated in FIGS. 15 and 16, the left and right constituent members S-3*a,* S-3*b* for the slider S are connected and fixed to each other by means of a connecting base plate C-1, which is constituted in an opening and closing manner through a flexural portion C-2 formed on part of the connecting base plate C-1, the opening and closing portion is equipped on the rear side thereof with an inside guide S-1, and the opening and closing portion is closed in the post step so that the inside guide S-1 is fitted and fixed in between the constituent members S-3*a,* S-3*b*.

Using a bag-making machine simultaneously with bag production, continuously carries out a series of operations for attaching the slider S to the bag body equipped with a plastic zipper. In these operations, as exemplified in FIG. 17, the bottom of the slider S is opened in a state that the zipper is closed, the slider S is attached to the zipper portion from above the zipper C, and the bottom of the slider S is closed. Subsequently, as exemplified in FIG. 18, the top of the zipper C is opened by opening jigs T-1, T-2 that are in thin rod form, and inserted between the hook and the protrusions G1-1, G1-2, said hook being on the opening side (upper side) of the zipper C on the opening end side of the slider S, and thereafter the opening and closing portion of the connecting base plate C-1 equipped with the inside guide S-1 is closed through a flexural portion C-2, so that C-1 is fitted into the slider body (FIG. 19), and thereafter the jigs T-1, T-2 are closed.

Detailed explanation will be given in the following description regarding the specific production process. Firstly in the first step, the film F which constitutes a bag body and the hermetic sealing zipper in the form of tape are discharged through the end of a bag making machine; then in the second step, the film F is adhered to the flange on the content side of the zipper by heat sealing; subsequently in the third step, hollows H-1, H-2 to penetrate through the hooks on the opening side of the zipper and through the protrusions G2-1, G2-2 are bored; then in the fourth step, the slider S is fitted to the top of the zipper by the foregoing method, and subsequently the zipper portions on both ends of the bag are heat sealed by means of a ultrasonic sealing machine or the like; thereafter in the fifth step, the overhanged portion inside the bag (overhanged heat sealed portion) is corrected in the shape; subsequently in the sixth step, the bag ends are heat sealed; and in the seventh step, the heat sealed portion is cut off at the center line, so that the bag body equipped with a plastic zipper having a slider is produced.

The present invention will be described in further details with reference to example.

EXAMPLE

There was prepared a flat bag which was sealed on three sides and which measured 140 mm wide by 200 mm high by the use of laminate films which had been dry laminated so that the bag inside consisted of 60 micron thick LL-polyethylene resin film and the bag outside consisted of 16-micron thick polyamide resin film. Then the flat bag thus prepared was equipped with a hermetic sealing zipper as illustrated in FIG. 3 by heat sealing the flange portion on the content side onto the inside of the opening end of the flat bag, wherein the hermetic sealing zipper was composed of low-density polyethylene resin as constructional material, measured 3.9 mm wide in zipper portion C by 2.6 mm thick by 7 mm long in the content side of the zipper portion each in a state of engagement, and the flanges for male/female hooks were each fitted with a protrusion measuring 0.6 mm long by 0.5 mm high at a position of 1.9 mm from the female hook F2-1 of the flange portion on the opening side.

Hollows H-1, H-2 as illustrated in FIG. 4 each measuring 11 mm long by 1 mm wide were provided between the hooks on the zipper portion and the protrusions G2-1, G2-2 at a position of 0.5 mm from one side of the heat seal portions on both ends of the zipper portion. Specifically illustrated as overhanged heat seal portion HS-6 in FIG. 14, the heat seal portion on the zipper portion was overhanged to the inside of the bag by 6 mm at the closing end of the zipper, so that a bag body equipped with a plastic zipper was prepared. Further, the resultant bag body was equipped with a slider S as illustrated in FIG. 7 that was made of high density polyethylene and measured 11 mm long by 11 mm wide by 12 mm high, wherein the inside guide S-1 had a maximum width of 7 mm, so that a bag body equipped with the plastic zipper having the slider was prepared.

Ten bag bodies of the above-mentioned type were prepared as specimens and tested. Specifically, the plastic zipper was opened with the slider, the bag was filled with 700 milliliter of water, and then the zipper was closed with the slider. Subsequently, a measurement was made of the drop strength thereof by a method in accordance with JIS Z-0238 wherein the bag bodies to be tested were dropped from a drop height of 30 cm in such a direction that the horizontal portion of the bag body and the zipper portion impinged upon a floor surface. Further the compression strength thereof was measured at 45 Kgf. As a result, any and all of the 10 specimens were completely free from leakage in the above-mentioned measurements of drop strength and compression strength.

Consequently, it has been proved that the bag body equipped with the plastic zipper having a slider according to the present invention is surpassingly excellent in impact resistance and leakage resistance, and thus endures practical application as a packaging material on which impact or internal stress is imposed, and further as a packaging material for liquid in a large capacity.

Figure 21:
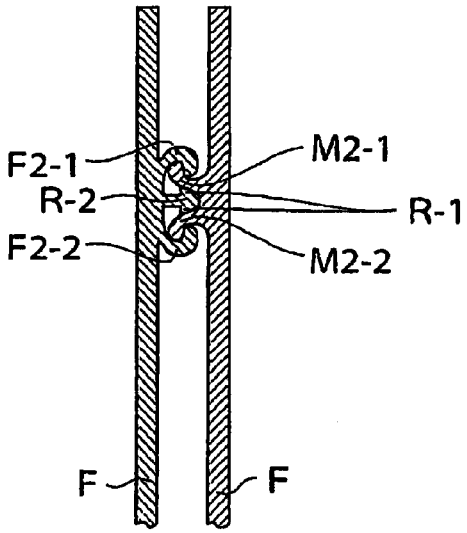
FIG. 21 is a cross sectional view showing a hermetic sealing zipper that was previously proposed by the present inventors.

The flat bag same as in Example 1 was equipped with a hermetic sealing zipper as illustrated in FIG. 21 by heat sealing the flange portion on the content side onto the inside of the opening end of the flat bag, wherein the hermetic sealing zipper was composed of low density polyethylene resin as constructional material, measured 3.9 mm wide in the zipper portion by 2.6 mm thick by 7 mm long in the content side of the zipper portion by 2 mm long in the flange on the opening side each in a state of engagement, so that the bag body equipped with the plastic zipper was prepared. Further, the resultant bag body was equipped with a general-purpose type slider, which was made of high density polyethylene and had such structure that an inside guide was inserted between a male hook and a female hook for the plastic zipper, so that the bag body equipped with the plastic zipper having the slider was prepared.

Ten bag bodies of the above-mentioned type were prepared as specimens and were tested to measure the drop strength and compression strength in the same manner as in the Example. As a result, any and all of the 10 specimens revealed leakages in the measurements of both drop strength and compression strength.

Consequently, it has been judged that the conventional bag body equipped with the plastic zipper having the general purpose type slider involves a problem on leakage resistance, and thus is unusable for practical application as a packaging material for liquid.

Industrial Applicability

The plastic zipper with the slider and bag body equipped with the plastic zipper according to the present invention are capable of improving poor hermetic sealing performance inherent in a conventional zipper, and serving as plastic zipper with a slider without impairing the hermetic sealing characteristics thereof. Accordingly, the foregoing bag body equipped with the plastic zipper is also capable of expand the utilization fields to a great extent.

Furthermore, according to the process for producing the bag body equipped with the plastic zipper having a slider, the foregoing slider can readily be fitted to the bag body equipped with the plastic zipper, thereby enabling to simply produce the bag body excellent in hermetic sealing characteristics and to inexpensively provide the same.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A plastic zipper with a slider, comprising:

a male hook and a female hook formed on plastic films; and a slider by which the zipper is adapted to be opened and closed, wherein the zipper includes protrusions serving as a guide for the slider which are disposed parallel to the male hook and the female hook on a side of an opening portion of the zipper, wherein the slider comprises side members disposed opposite one another and connected to a base member, a movable member connected through a flexural portion to the base member, the movable member configured to rotate via the flexural portion about an axis perpendicular to lengths of the protrusions when the slider is disposed on the protrusions, and an inside guide connected to the movable member and configured to engage the protrusions so that the inside guide is positioned between the protrusions and the hooks on the side of the opening portion of the zipper, and wherein said inside guide is formed in a bilaterally asymmetrical manner and is adapted to open the female hook outward and thereafter to open the male hook.

2. The plastic zipper according to claim 1, wherein hollows adapted to allow the inside guide of the slider to fit therein are disposed on the side of the opening portion of the zipper.

3. A bag body that is equipped with the plastic zipper with the slider as set forth in claim 1.

4. The bag body according to claim 3, wherein a length of a heat seal extending from a side of the bag body toward an interior of the bag body is at least equal to a distance from a starting point of a portion of the slider configured to open the hooks and a starting point of a portion of the slider configured to close the hooks.

5. A plastic zipper with a slider, comprising:

a male hook and a female hook formed on plastic films; and a slider by which the zipper is adapted to be opened and closed, wherein the zipper includes protrusions serving as a guide for the slider which are disposed parallel to the male hook and the female hook on a side of an opening portion of the zipper, wherein the slider comprises side members disposed opposite one another and connected to a base member, a movable member connected through a flexural portion to the base member, the movable member configured to rotate via the flexural portion about an axis perpendicular to lengths of the protrusions when the slider is disposed on the protrusions, and an inside guide connected to the movable member and configured to engage the protrusions so that the inside guide is positioned between the protrusions and the hooks on the side of the opening portion of the zipper, and wherein said zipper is a hermetic sealing zipper that is equipped with a continuous tightening wall inside the male hook and a continuous pressing rib inside the female hook.

6. The plastic zipper according to claim 5, wherein said inside guide is formed in a bilaterally asymmetrical manner and is adapted to open the female hook outward, and thereafter to open the male hook.

7. The plastic zipper according to claim 5, wherein hollows adapted to allow the inside guide of the slider to fit therein are disposed on the side of the opening portion of the zipper.

8. A bag body that is equipped with the plastic zipper with the slider as set forth in claim 5.

9. The bag body according to claim 8, wherein a length of a heat seal extending from a side of the bag body toward an interior of the bag body is at least equal to a distance from a starting point of a portion of the slider configured to open the hooks and a starting point of a portion of the slider configured to close the hooks.

* * * * *